US009229382B2

(12) United States Patent
Kondo

(10) Patent No.: US 9,229,382 B2
(45) Date of Patent: Jan. 5, 2016

(54) FIXING DEVICE HAVING A SEPARATION MEMBER TO PREVENT A RECORDING MEDIUM FROM BEING WRAPPED AROUND A HEATED ROLLER MEMBER AND IMAGE FORMING APPARATUS INCLUDING THE SAME

(71) Applicant: KYOCERA Document Solutions Inc., Osaka (JP)

(72) Inventor: Akihiro Kondo, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/720,732

(22) Filed: May 22, 2015

(65) Prior Publication Data

US 2015/0355583 A1 Dec. 10, 2015

(30) Foreign Application Priority Data

Jun. 6, 2014 (JP) ..... 2014-117942

(51) Int. Cl.
*G03G 15/20* (2006.01)

(52) U.S. Cl.
CPC ..... *G03G 15/2028* (2013.01)

(58) Field of Classification Search
CPC ..... G03G 15/2028; G03G 15/6573
See application file for complete search history.

(56) References Cited

U.S. PATENT DOCUMENTS 6,785,503 B2 * 8/2004 Kuo et al. ..... 399/323
8,811,868 B2 * 8/2014 Park et al. ..... 399/320
2002/0164171 A1 * 11/2002 Takami ..... 399/22
2004/0091279 A1 * 5/2004 Izawa et al. ..... 399/67
2008/0124140 A1 * 5/2008 Thomas et al. ..... 399/323
2009/0080953 A1 * 3/2009 Hamilton et al. ..... 399/323
2009/0110452 A1 * 4/2009 Ogata ..... 399/331
2010/0014898 A1 * 1/2010 Nakajima ..... 399/322
2011/0188904 A1 * 8/2011 Kageyama et al. ..... 399/323
2012/0082492 A1 * 4/2012 Park et al. ..... 399/324
2014/0029992 A1 * 1/2014 Yamamoto ..... 399/328
2014/0086644 A1 * 3/2014 Yasuda ..... 399/322
2014/0219673 A1 * 8/2014 Yamamoto et al. ..... 399/69
2014/0356018 A1 * 12/2014 Nakamura et al. ..... 399/99

FOREIGN PATENT DOCUMENTS

JP 2005-258041 A 9/2005
JP 2013117672 A * 6/2013

* cited by examiner

*Primary Examiner* — Clayton E Laballe
*Assistant Examiner* — Ruifeng Pu
(74) *Attorney, Agent, or Firm* — Stein IP LLC

(57) ABSTRACT

A fixing device includes a heated roller member, a pressure member, a separation member, and a discharge state switching mechanism. The heated roller member is heated by heating means. The pressure member contacts with the heated roller member so as to form a fixing nip portion. The separation member is conductive and disposed with a predetermined gap to a surface of the heated roller member, so as to separate a recording medium after passing through the fixing nip portion from the heated roller member. The discharge state switching mechanism switches between a discharge permissive condition that permits discharge from the heated roller member to the separation member and a discharge restricted condition that restricts the discharge from the heated roller member to the separation member.

8 Claims, 9 Drawing Sheets

FIXING DEVICE HAVING A SEPARATION MEMBER TO PREVENT A RECORDING MEDIUM FROM BEING WRAPPED AROUND A HEATED ROLLER MEMBER AND IMAGE FORMING APPARATUS INCLUDING THE SAME

INCORPORATION BY REFERENCE

This application is based upon and claims the benefit of priority from the corresponding Japanese Patent Application No. 2014-117942 filed Jun. 6, 2014, the entire contents of which are hereby incorporated by reference.

BACKGROUND

The present disclosure relates to a fixing device for fixing a toner image transferred onto a recording medium, and an image forming apparatus such as a copier or a printer including the fixing device. In particular, the present disclosure relates to a fixing device including a separation plate for preventing the recording medium from being wrapped around a heated roller member such as a fixing roller.

In a conventional image forming apparatus of an electrophotographic method, an image carrier such as a photosensitive drum that is uniformly electrified by an electrifying device is irradiated with a laser beam from an exposing device, and hence a predetermined electrostatic latent image is formed in which charge is partially attenuated. Then, a developing device generates a toner image by causing toner to adhere to the electrostatic latent image, transfer means transfer the toner image onto a paper sheet (recording medium), and a fixing device heats and press the unfixed toner to be a permanent image, so that an image forming process is performed.

In the fixing device described above, there is a problem that a paper sheet is wrapped around the fixing roller (heated roller member) or a pressure roller (pressure member) constituting a fixing roller pair (fixing member), resulting in jamming. It is a general method to secure paper sheet separation performance by disposing a separation member such as a separation claw or the separation plate on the downstream side of the nip portion (fixing nip portion) between the fixing member and the pressure member and by precisely controlling a gap between the tip of the separation member and the fixing member (or the pressure member). Further, in a color image forming apparatus, more toner adheres onto the paper sheet than in a monochrome image forming apparatus, and hence melted toner is easily adhered to the fixing member. For this reason, a tube or a coat layer of fluorine-based resin such as PFA is usually disposed as a releasing layer on a surface of the fixing member.

When the above-mentioned releasing layer is disposed on the surface of the fixing member, there is a problem that poor transfer or electrostatic offset easily occurs when a paper sheet containing excessive moisture under a high temperature and high humid environment is fed to the fixing nip portion.

There is known a fixing device provided with transfer member detection means including an actuator that can rotate about a rotation axis on a downstream side in a transport direction of a transfer member (paper sheet) and contacts with the transfer member so as to detect passing of the transfer member, and a conductive member rotating integrally with the actuator. In this fixing device, the conductive member rotates to be away from the ground electrode and the surface of the pressure roller when the passing of the transfer member is not detected by the actuator, while the conductive member rotates to contact with the ground electrode and the surface of the pressure roller when the passing of the transfer member is detected by the actuator. In this way, it is possible to prevent electrostatic offset due to charge accumulated on the pressure roller by bringing the conductive member to contact with pressure roller.

SUMMARY

A fixing device according to an aspect of the present disclosure is a fixing device including a heated roller member, a pressure member, a separation member, and a discharge state switching mechanism. The heated roller member is heated by heating means. The pressure member contacts with the heated roller member so as to form a fixing nip portion. The separation member is conductive and is disposed with a predetermined gap from a surface of the heated roller member so as to separate the recording medium after passing through the fixing nip portion from the heated roller member. The discharge state switching mechanism switches between a discharge permissive condition in which discharge from the heated roller member to the separation member is permitted and a discharge restricted condition in which the discharge from the heated roller member to the separation member is restricted.

Further objects and specific advantages of the present disclosure will become apparent from the description of embodiments given below.

DETAILED DESCRIPTION

Figure 1:
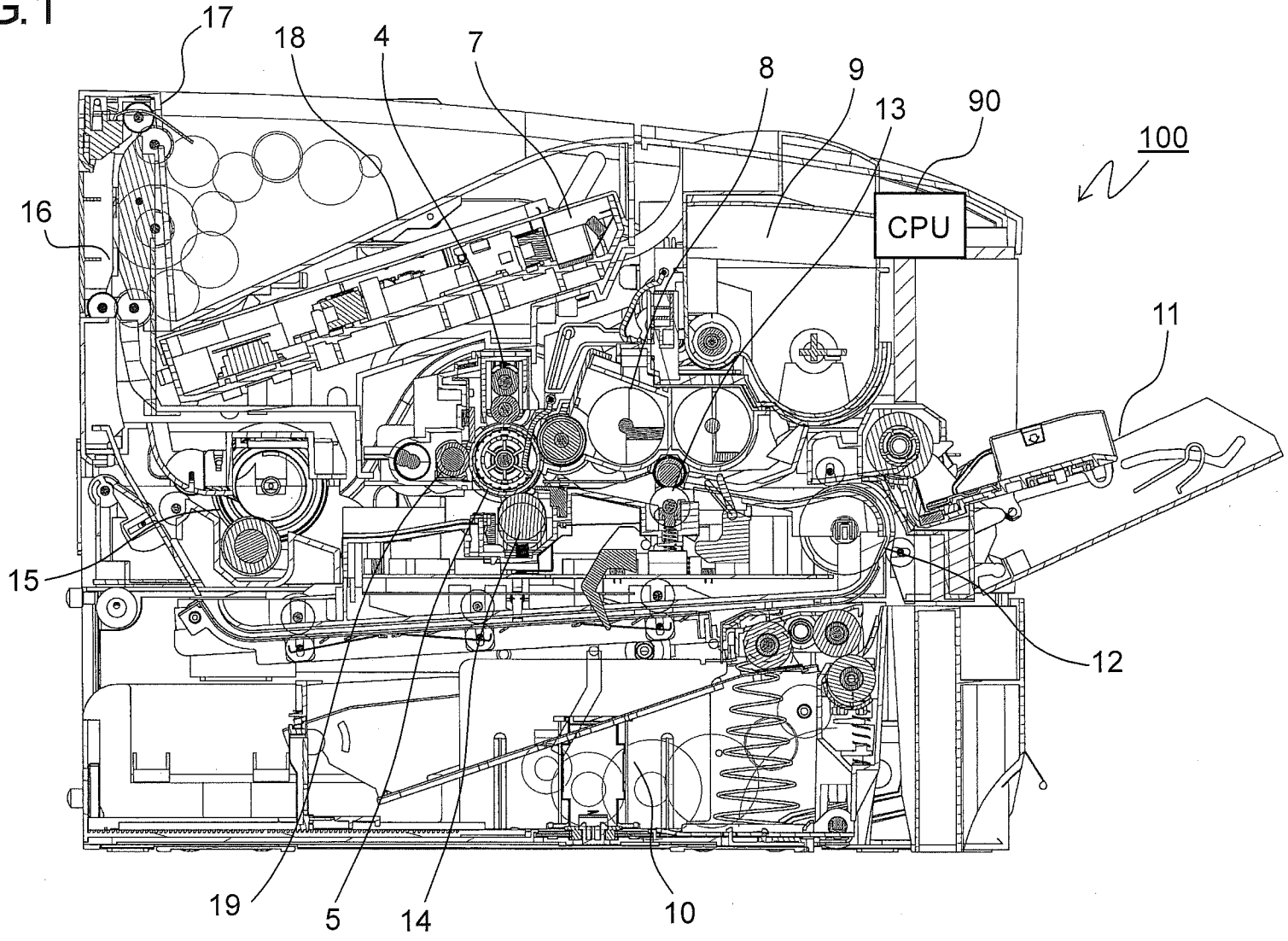
FIG. 1 is a side cross-sectional view of an image forming apparatus 100 equipped with a fixing device 15 of the present disclosure.

Embodiments of the present disclosure is now described with reference to the drawings. FIG. 1 is a side cross-sectional view of an image forming apparatus 100 according to an embodiment of the present disclosure. In the image forming apparatus (for example, a monochrome printer) 100, when performing an image forming operation, an electrifying device 4 uniformly electrifies a photoreceptor drum 5 that rotates in a clockwise direction in FIG. 1. A laser beam from an exposing device (such as a laser scanning unit) 7 forms an electrostatic latent image based on document image data on the photoreceptor drum 5, and a developing device 8 forms a toner image by causing developer (hereinafter referred to as toner) to adhere to the electrostatic latent image.

The toner is supplied to the developing device 8 from a toner container 9. Note that the image data is transmitted from a personal computer (not shown) or the like. In addition, a charge neutralizer (not shown) for removing remaining charge on the surface of the photoreceptor drum 5 is disposed on the downstream side of a cleaning device 19 in a rotation direction of the photoreceptor drum 5.

A paper sheet is transported from a sheet feed cassette 10 or a manual paper sheet tray 11 to the photoreceptor drum 5 on which the toner image is formed as described above, via a paper sheet transport path 12 and a registration roller pair 13, and the toner image formed on the surface of the photoreceptor drum 5 is transferred onto the paper sheet by a transfer roller 14 (image transfer portion). The electrifying device 4, the photoreceptor drum 5, the exposing device 7, the developing device 8, the transfer roller 14, and the cleaning device 19 constitute an image forming portion for forming a toner image on the paper sheet. The paper sheet on which the toner image is transferred is separated from the photoreceptor drum 5 and is transported to a fixing device 15 so that the toner image is fixed. The paper sheet after passing through the fixing device 15 is transported along a paper sheet transport path 16 to the main body upper part of the image forming apparatus 100 and is discharged to a discharge tray 18 by a discharge roller pair 17.

Further, in the image forming apparatus 100, there is disposed a controller (CPU) 90 that controls operations of the electrifying device 4, the exposing device 7, the developing device 8, the registration roller pair 13, the fixing device 15, the cleaning device 19, and the like.

Figure 2:
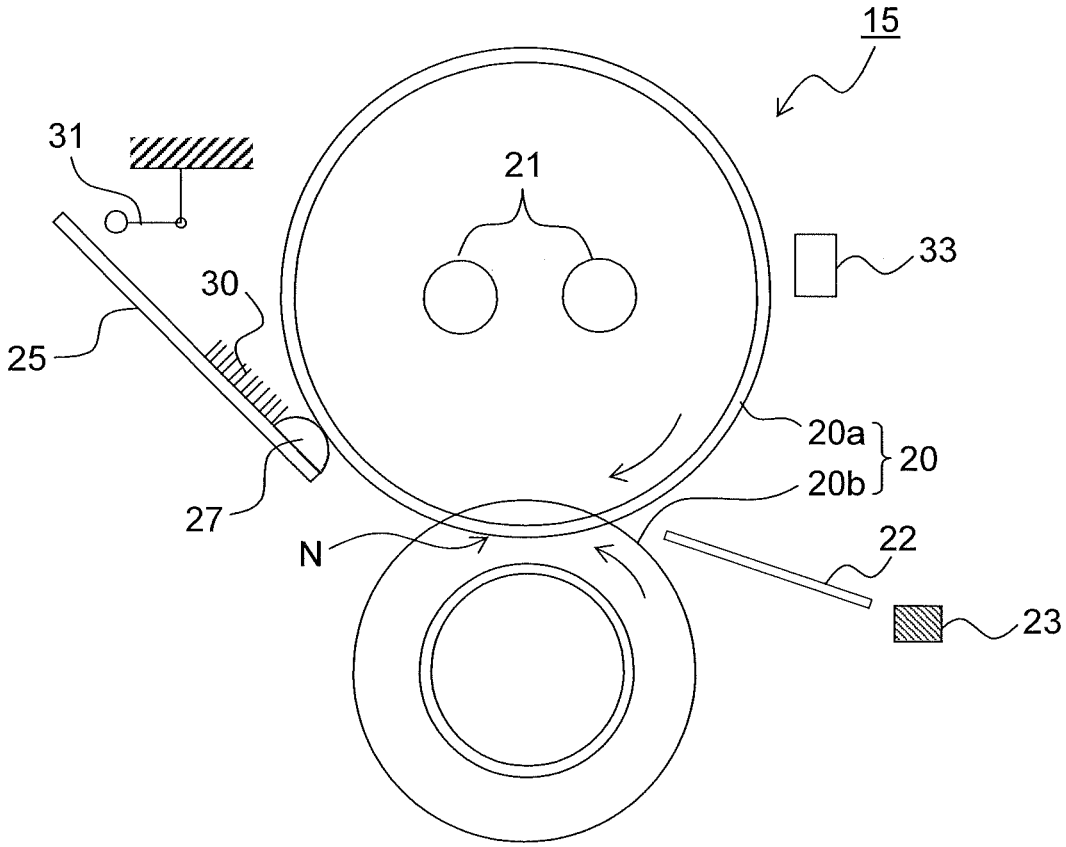
FIG. 2 is a side cross-sectional view showing an example of the fixing device 15 according to a first embodiment of the present disclosure and is a diagram showing a state in which a ground member 31 contacts with a separation plate 25.
Figure 3:
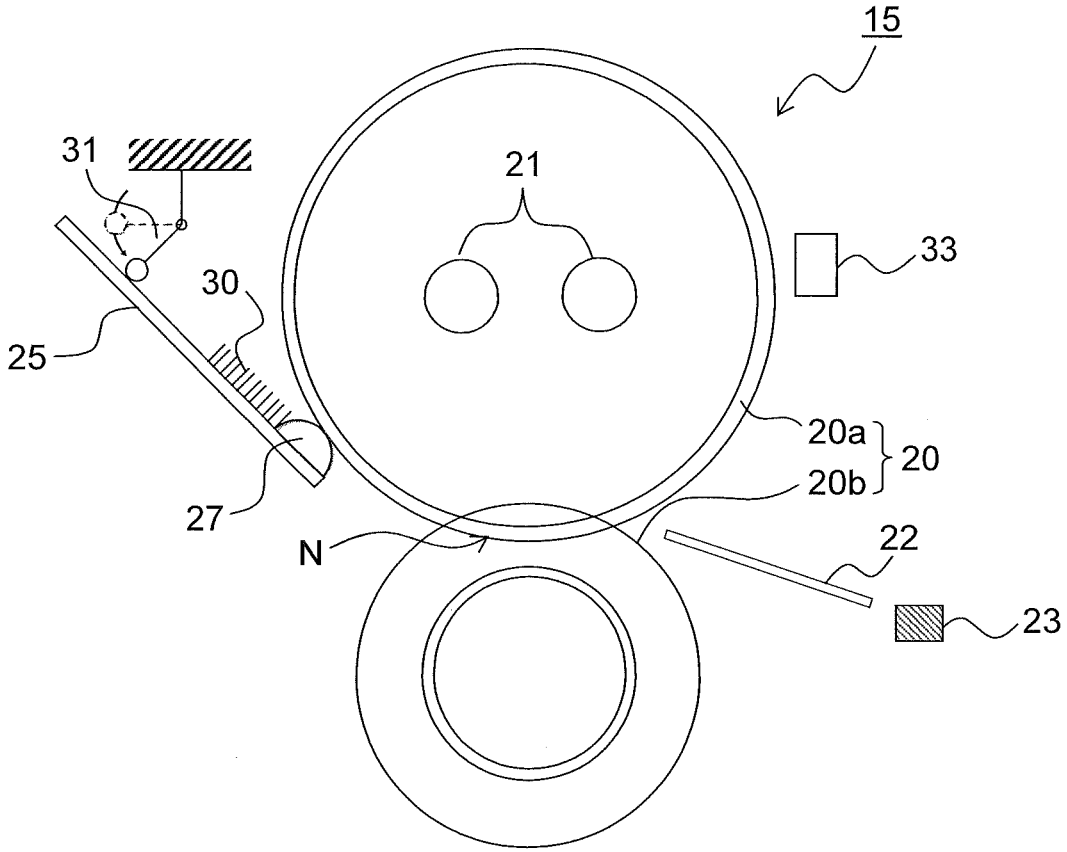
FIG. 3 is a side cross-sectional view showing an example of the fixing device 15 according to the first embodiment and is a diagram showing a state in which the ground member 31 is separated from the separation plate 25.

FIGS. 2 and 3 are side cross-sectional views of the fixing device 15 of the first embodiment used in the image forming apparatus 100 of FIG. 1. As shown in FIGS. 2 and 3, the fixing device 15 includes a fixing roller pair 20, a fixing approach guide 22, a paper sheet detection sensor 23, a separation plate 25, and a temperature sensor 33. Note that a housing of the fixing device 15 is not shown in FIGS. 2 and 3.

The fixing roller pair 20 is constituted of a fixing roller 20*a* rotating in the clockwise direction in FIG. 2 by a drive motor (not shown) and a pressure roller 20*b* in a counterclockwise direction following the fixing roller 20*a*. A heater 21 is embedded in the fixing roller 20*a*. The pressure roller 20*b* is pressed to the fixing roller 20*a* by biasing means (not shown) at a predetermined pressure so as to form a fixing nip portion N. The fixing roller pair 20 fixes the unfixed toner on the paper sheet passing through the fixing nip portion N.

As a structure of the fixing roller 20*a* used in this embodiment, there is a lamination of a coat layer (releasing layer) of PFA resin (Tetrafluoroethylene-Perfluoroalkylvinylether Copolymer) formed on a circumferential surface of a cylindrical base made of stainless steel, for example. In addition, as a structure of the pressure roller 20*b*, there is one in which a silicone rubber layer (elastic layer) is formed on a metal core made of aluminum and is covered with a PFA tube (releasing layer).

The heater 21 may be a halogen heater or may be an IH heater equipped with an induction heating portion including an exciting coil and a core. Here, a halogen heater is used as the heater 21.

The fixing approach guide 22 for guiding the paper sheet to the fixing nip portion N is disposed on an upstream side of the fixing nip portion N in a paper sheet transport direction (from right to left in FIG. 2). In addition, the paper sheet detection sensor 23 for detecting passing of a front end and a rear end of the paper sheet is disposed near the upstream side of the fixing approach guide 22. The paper sheet detection sensor 23 is constituted of, for example, a fixing actuator protruding to the paper sheet transport path so as to swing when the paper sheet passes, and a photointerrupter (PI) sensor that is turned on or off when the fixing actuator swings.

The separation plate 25 for separating the paper sheet from the fixing roller 20*a* is disposed on the downstream side of the fixing nip portion N in the rotation direction (clockwise direction) of the fixing roller 20*a*. The separation plate 25 is a plate-like member extending in a width direction of the fixing roller 131 (in the direction perpendicular to the paper plane of FIG. 2) and is a member for separating the paper sheet after the fixing process from the surface of the fixing roller 20*a*. The separation plate 25 is made of metal (conductive material) such as stainless steel.

A pair of gap restriction members 27 are fixed by screws or the like at both ends in the width direction (perpendicular to the paper plane of FIG. 2) on the upstream side end portion (lower end portion in FIG. 2) of the separation plate 25 in the paper sheet transport direction. When the gap restriction members 27 contacts with both end portions in the axis direction of an outer circumferential surface of the fixing roller 20*a*, a gap between the upstream side end portion of the separation plate 25 and the surface of the fixing roller 20*a* is set to a predetermined gap. By disposing the separation plate 25 in this state, the front end of the paper sheet after passing through the fixing nip portion N is guided along the separation plate 25 and is separated from the surface of the fixing roller 20*a*. The gap restriction member 27 is made of insulating material such as resin.

The temperature detection sensor 33 constituted of a thermistor or the like is disposed on the upstream side of the fixing nip portion N in the rotation direction of the fixing roller 20*a*. This temperature detection sensor 33 detects surface temperature of the fixing roller 20*a* in a non-contact manner, and a result of the detection is transmitted to the controller 90 (see FIG. 1). Further, current flowing in the heater 21 is turned on and off based on a control signal from the controller 90 so that the fixing temperature is controlled.

The paper sheet on which the toner image is transferred by the transfer roller 14 (see FIG. 1) proceeds to the left in FIG. 2, is introduced into the fixing device 15 through an upstream side opening portion of the housing, and is guided to the fixing nip portion N of the fixing roller pair 20 along the fixing approach guide 22. When the paper sheet passing through the fixing nip portion N, the paper sheet is heated at a predetermined temperature and is pressed by a predetermined pressure so that the toner image on the paper sheet becomes a permanent image. After that, the paper sheet is separated by the separation plate 25 from the fixing roller 20*a*, is transported from the downstream side opening portion of the housing to the outside of the fixing device 15, and is discharged from the discharge roller pair 17 (see FIG. 1) to the outside of the image forming apparatus 100.

In the fixing device 15 described above, there is a problem that an image defect is apt to occur when the releasing layer formed on the surface of the fixing roller 20*a* is electrified. Specifically, because the fluorine contained in the PFA resin used for the releasing layer is positioned at the negative-most side in the electrostatic charging series, negative charge amount of the releasing layer surface made of the PFA resin is increased by friction with the paper sheet due to continuous paper feeding. Further, a local potential fluctuation occurs on the surface of the fixing roller 20*a* by a local discharge at the tip of the separation plate 25 disposed close to the fixing roller 20*a* when the charge amount reaches a predetermined amount. As a result, the unfixed toner image on the paper sheet that next reaches the fixing nip portion N is scattered so that electrostatic scattering occurs. This phenomenon is apt to occur particularly in the case where a paper sheet having high resistance is fed to the fixing nip portion N in low temperature and low humidity environment.

As a countermeasure for this phenomenon, there are the following techniques. First, there is a technique of suppressing the negative electrification itself by forming the releasing layer on the surface of the fixing roller 20*a* of a conductive PFA tube to which conductive material such as carbon is mixed instead of pure PFA resin. In this method, however, there is a tendency that release property of the paper sheet from the surface of the fixing roller 20*a* is deteriorated, and the deterioration causes influence to the fixed image and a problem of durability due to adhesion of toner or paper powder to the fixing roller 20*a*.

In addition, it is considered to polish or grind the tip of the separation plate 25 so that discharge from the surface of the fixing roller 20*a* occurs actively or to additionally dispose a non-contact type neutralizing member to face the surface of the fixing roller 20*a* so that the charge on the surface of the fixing roller 20*a* is always suppressed. Also in this method, however, when the surface of the fixing roller 20*a* is electrified to a predetermined amount, the local discharge to the neutralizing member is still repeatedly generated, and it is confirmed that this method is not a basic countermeasure even if occurrence frequency of the electrostatic scattering is reduced.

In addition, it is also confirmed that when the separation plate 25 is electrically insulated (in a float state), occurrence of the local discharge is reduced so that the electrostatic scattering can be canceled. In this method, however, because there is no discharge path from the surface of the fixing roller 20*a*, there are other problems as well, which include occurrence of a noise or an abnormal image when the surface potential of the fixing roller 20*a* is further increased, and occurrence of jamming when the separation plate 25 itself is electrified so that the paper sheet is stuck to the separation plate 25.

In the fixing device 15 of the present disclosure, a state permitting the discharge from the fixing roller 20*a* to the separation plate 25 (hereinafter referred to as a discharge permissive condition) and a state restricting the discharge from the fixing roller 20*a* to the separation plate 25 (hereinafter referred to as a discharge restricted condition) are switched at predetermined timings, so that the local discharge from the fixing roller 20*a* to the separation plate 25 is actively generated. Thus, excessive charge on the fixing roller 20*a* is suppressed, and local discharge timing is controlled so as to prevent occurrence of the electrostatic scattering.

In the first embodiment shown in FIGS. 2 and 3, a neutralizing sheet 30 made of conductive fibers is adhered to the surface of the separation plate 25 facing the fixing roller 20*a*. The neutralizing sheet 30 has a brush-like (or nap-raised) surface so that the local discharge easily occurs from the fixing roller 20*a* to the tip of the brush. In addition, near the downstream side end portion (the upper end portion in FIG. 2) of the separation plate 25 in the paper sheet transport direction, a ground member 31 is disposed. The ground member 31 is selectively positioned between a position contacting with the separation plate 25 as shown in FIG. 2 and a position separating from the separation plate 25 as shown in FIG. 3. In this embodiment, the separation plate 25 is switched between the ground (earth) state and the insulated (float) state at predetermined timings so that the discharge permissive condition and the discharge restricted condition are switched.

Figure 4:
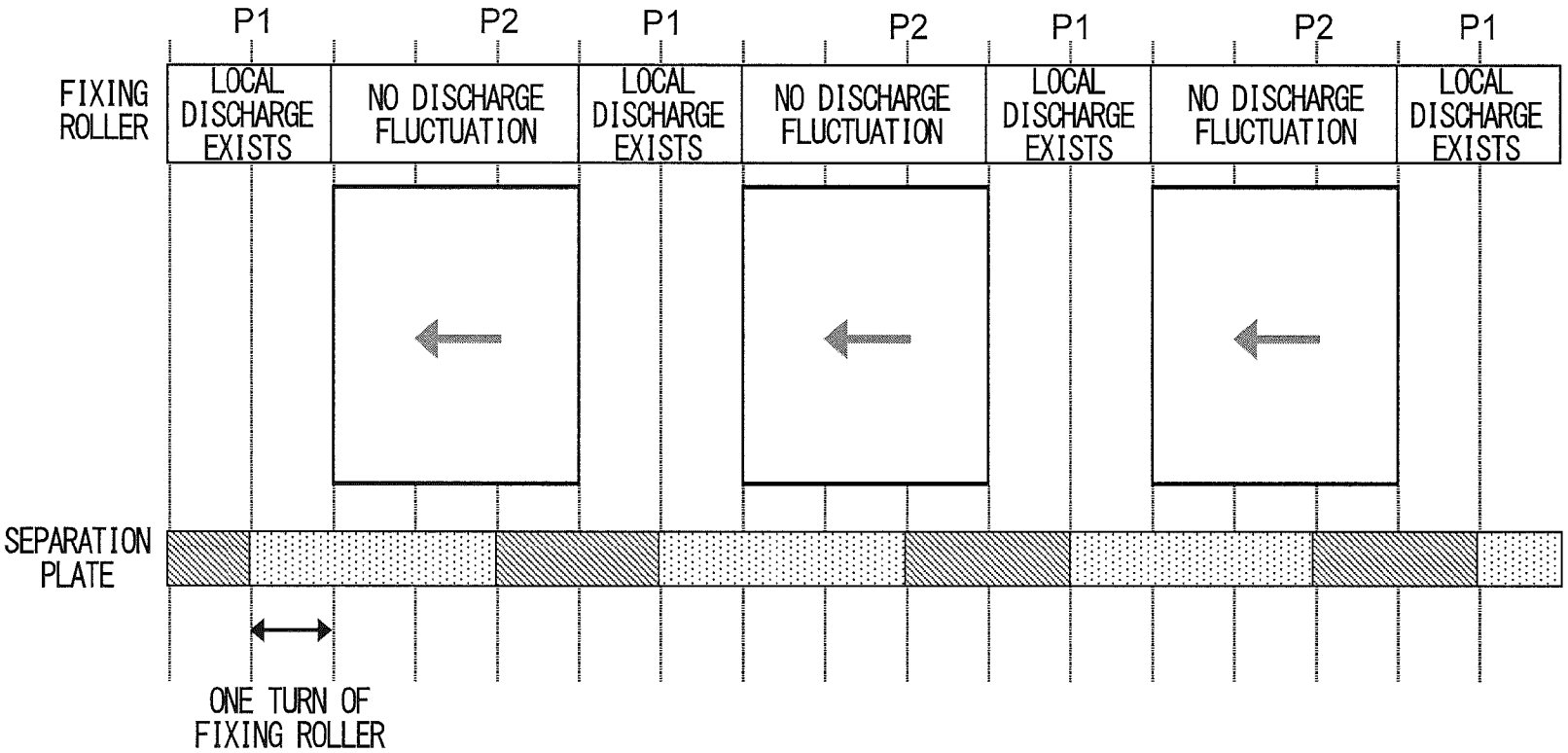
FIG. 4 is a timing chart showing a relationship between paper sheet pass timing at a fixing roller pair 20 and switch timing to an insulated state or a ground state of the separation plate 25 in the fixing device 15 of the first embodiment.
Figure 5:
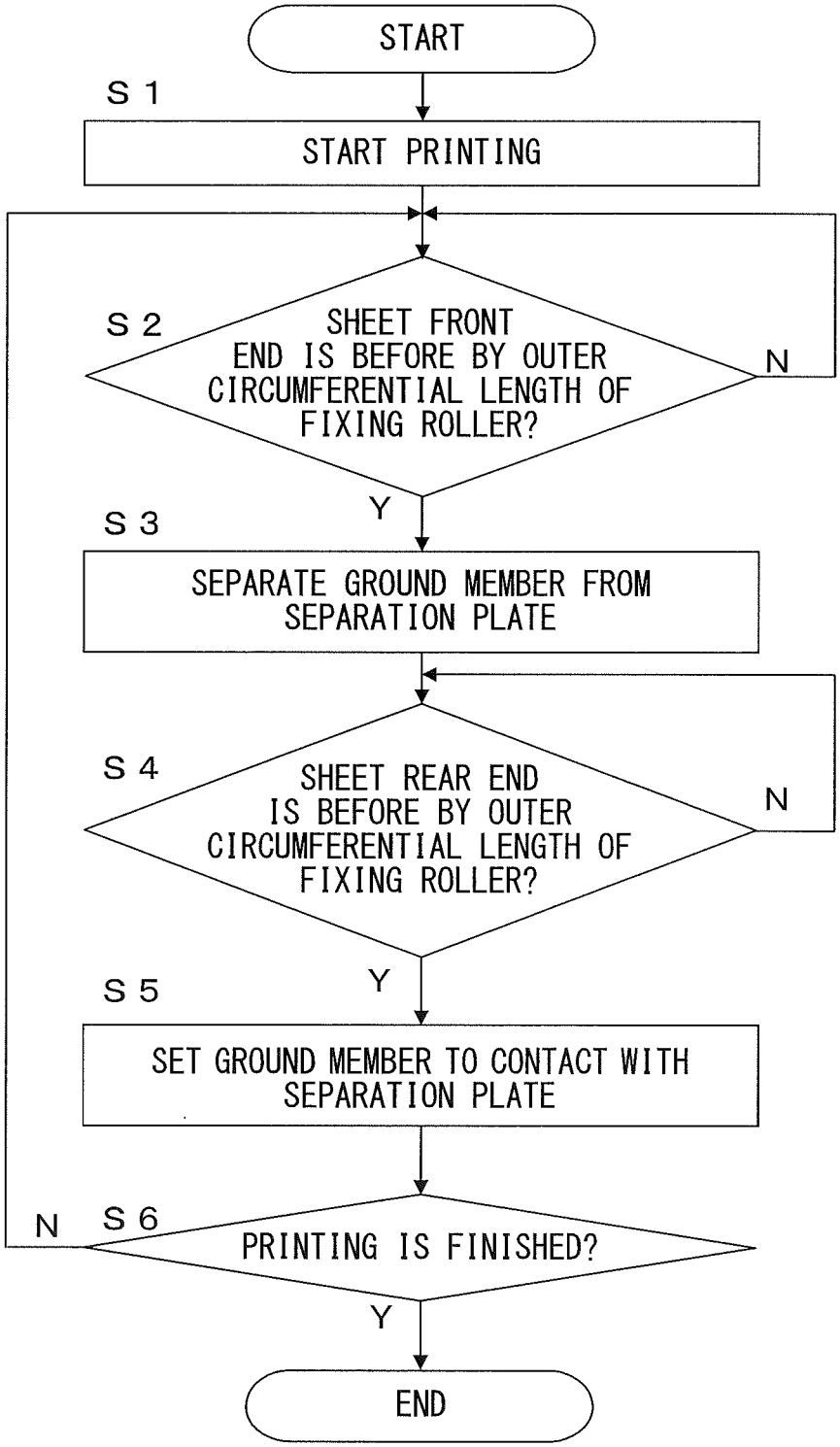
FIG. 5 is a flowchart showing a discharge control procedure of a fixing roller 20*a* in the fixing device 15 of the first embodiment.

FIG. 4 is a timing chart showing a relationship between a paper sheet pass timing at the fixing roller pair 20 and a switch timing to the insulated state or the ground state of the separation plate 25 in the fixing device 15 of this embodiment. FIG. 5 is a flowchart showing a discharge control procedure of the fixing roller 20*a* in the fixing device 15 of this embodiment. With reference to FIGS. 2 to 4, the procedure of switching the separation plate 25 to the insulated state or the ground state along the steps of FIG. 5 is described. Note that the ground state of the separation plate 25 is shown as hatching areas while the insulated state of the separation plate 25 is shown as dotted areas in FIG. 4.

When a print start command is input from master equipment such as a personal computer (Step S1), the fixing roller pair 20 constituted of the fixing roller 20*a* and the pressure roller 20*b* starts to rotate. At the same time, power supply to the heater 21 starts, and detection of the surface temperature of the fixing roller 20*a* by the temperature detection sensor 33 is also started. Further, the ground member 31 is at the position contacting with the separation plate 25 (as shown in FIG. 3) so that the separation plate 25 is connected to the ground when the printing starts.

When the surface temperature of the fixing roller 20*a* reaches at a predetermined temperature, the paper sheet is sent out from the sheet feed cassette 10 or the manual paper sheet tray 11. Further, the toner image is formed on the paper sheet in the image forming portion. Next, the controller 90 determines, on the basis of a detection signal of the paper sheet detection sensor 23, whether or not the front end of the paper sheet has reached a point before (on the upstream side of) the fixing nip portion N by an outer circumferential length of the fixing roller 20*a* (Step S2).

When the front end of the paper sheet reaches the point before the fixing nip portion N by the outer circumferential length of the fixing roller 20*a* (position P1 in FIG. 4) (YES in Step S2), the controller 90 outputs a control signal so as to rotate the ground member 31 to be away from the separation plate 25 as shown in FIG. 3 (Step S3). Thus, the separation plate 25 is switched from the ground state to the insulated state. Further, the fixing process is performed when the paper sheet with the transferred toner image passes through the fixing nip portion N. In addition, when the front end of the paper sheet enters into the fixing nip portion N, because the separation plate 25 is in the insulated state, the local discharge from the fixing roller 20*a* to the separation plate 25 does not occur, and hence the electrostatic scattering does not occur as well.

Next, the controller 90 determines, on the basis of the detection signal of the paper sheet detection sensor 23, whether or not the rear end of the paper sheet that is passing through the fixing nip portion N has reached a point before (upstream side of) the fixing nip portion N by the outer circumferential length of the fixing roller 20*a* (Step S4). When the rear end of the paper sheet reaches the point before the fixing nip portion N by the outer circumferential length of the fixing roller 20*a* (position P2 in FIG. 4) (YES in Step S4), the controller 90 outputs a control signal so as to rotate the ground member 31 to contact with the separation plate 25 as shown in FIG. 2 (Step S5). Thus, the separation plate 25 is switched again from the insulated state to the ground state.

In this state, the local discharge from the fixing roller 20*a* to the separation plate 25 can occur, and a local discharge point on the surface of the fixing roller 20*a* reaches the fixing nip portion N after approximately one turn of the fixing roller 20*a*. Thus, the separation plate 25 is set to the ground state at the point before the rear end of the paper sheet by the outer circumferential length of the fixing roller 20*a*. Even if the local discharge from the fixing roller 20*a* to the separation plate 25 occurs, fixing property is not affected because the local discharge point on the surface of the fixing roller 20*a* (at which a potential fluctuation has occurred) does not contact with the paper sheet that is passing through the fixing nip portion N.

After that, it is determined whether or not the printing is finished (Step S6). While the printing is continued (NO in Step S6), the process returns to Step S2, and afterwards the fixing process is repeated in the same procedure. While the printing is continued, because the separation plate 25 is switched again to the insulated state at the point before the front end of the paper sheet that is next transported to the fixing nip portion N by the outer circumferential length of the fixing roller 20 (between sheets), the electrostatic scattering image does not occur in the next paper sheet. On the contrary, when the printing is finished (YES in Step S6), the process is finished.

By switching the separation plate 25 to the insulated state or the ground state in the above-mentioned procedure, when the front end of the paper sheet enters the fixing nip portion N, the separation plate 25 is in the insulated state. For this reason, the local discharge from the fixing roller 20*a* to the separation plate 25 does not occur, and hence occurrence of the electrostatic scattering can surely be prevented.

In addition, considering that the history of the potential fluctuation by the local discharge remains only for the outer circumferential length of the fixing roller 20*a*, the separation plate 25 is set to the ground state at the point before the rear end of the paper sheet by the outer circumferential length of the fixing roller 20*a*. Thus, the separation plate 25 can be set in the ground state for as long a period as possible within a range that does not affect the fixing property of the toner image on the paper sheet that is passing through the fixing nip portion N. Thus, charge of the surface of the fixing roller 20*a* can be effectively suppressed.

In the control example described above, the separation plate 25 is switched from the ground state to the insulated state at the time point when the distance from the front end of the paper sheet to the fixing nip portion N becomes identical to the outer circumferential length of the fixing roller 20*a*. It is possible, however, to switch from the ground state to the insulated state at a time point when the distance from the front end of the paper sheet to the fixing nip portion N is longer than the outer circumferential length of the fixing roller 20*a*. In addition, the separation plate 25 is switched from the insulated state to the ground state at the time point when the distance from the rear end of the paper sheet to the fixing nip portion N becomes identical to the outer circumferential length of the fixing roller 20*a* as described above. It is possible, however, to switch from the insulated state to the ground state at a time point when the distance from the rear end of the paper sheet to the fixing nip portion N becomes smaller than the outer circumferential length of the fixing roller 20*a*.

Figure 6:
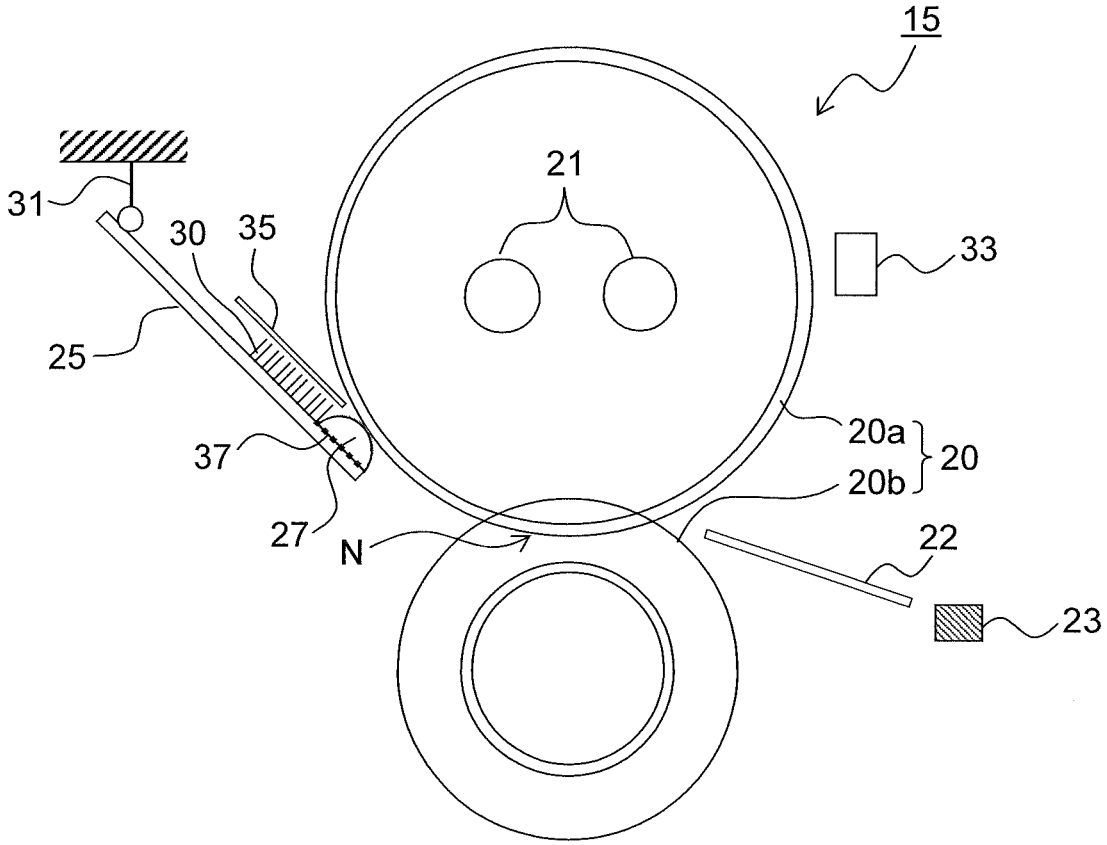
FIG. 6 is a side cross-sectional view showing an example of the fixing device 15 according to a second embodiment of the present disclosure and is a diagram showing a state in which a discharge restricting shutter 35 is disposed at an insulated position.
Figure 7:
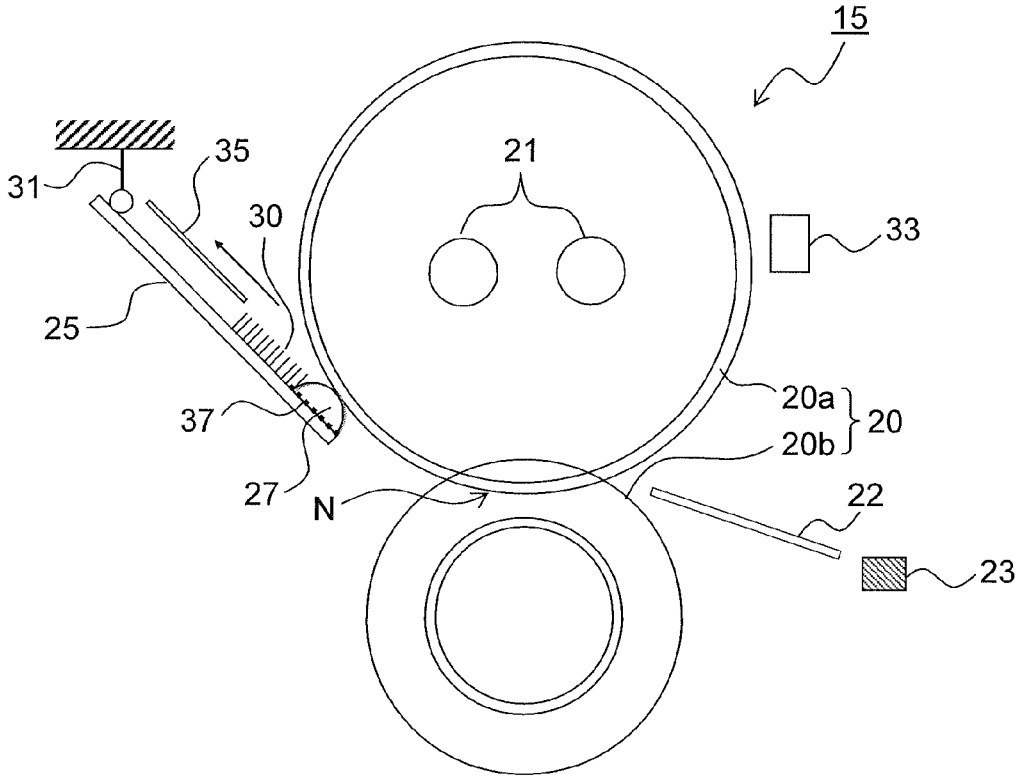
FIG. 7 is a side cross-sectional view showing an example of the fixing device 15 according to the second embodiment and is a diagram showing a state in which the discharge restricting shutter 35 is disposed in a discharge permissive position.
Figure 8:
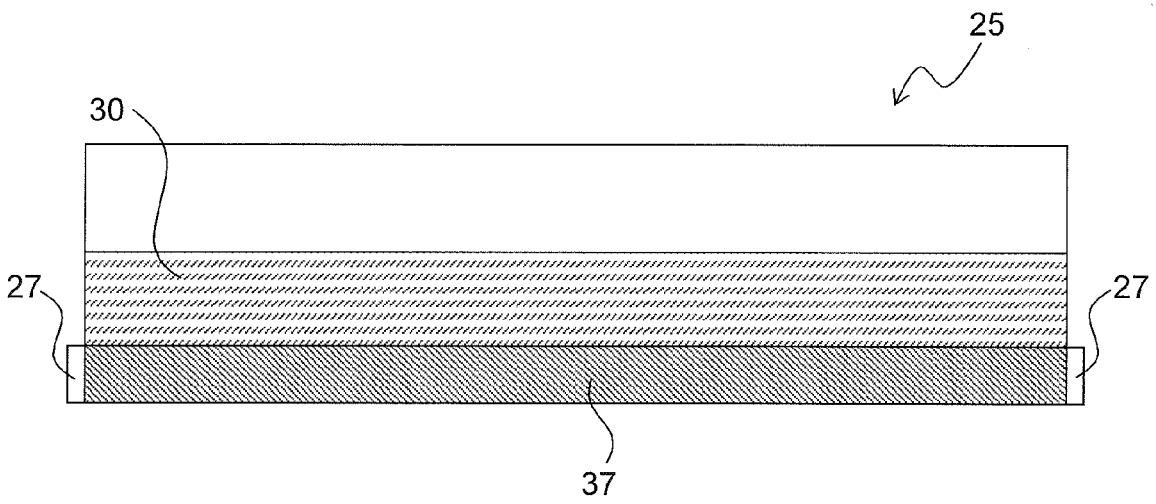
FIG. 8 is a plan view of the separation plate 25 used in the fixing device 15 of the second embodiment viewed from rear.

FIGS. 6 and 7 are side cross-sectional views of the fixing device 15 of the second embodiment that is used in the image forming apparatus 100 of FIG. 1. FIG. 8 is a plan view of the separation plate 25 that is used for the fixing device 15 of the second embodiment viewed from rear (right side in FIGS. 6 and 7). In this embodiment, the separation plate 25 is always connected to the ground (earth) by the ground member 31, and a discharge restricting shutter 35 made of an insulating material is disposed in a movable manner along the rear side of the separation plate 25. The discharge restricting shutter 35 is selectively positioned by a shutter drive mechanism (not shown) between the insulated position (of FIG. 6) between opposed portions of the neutralizing sheet 30 and the fixing roller 20*a*, and the discharge permissive position (of FIG. 7) retracted from the opposed portions of the neutralizing sheet 30 and the fixing roller 20*a*. In addition, an area from the upstream side end portion of the separation plate 25 (lower end portion in FIG. 8) to the neutralizing sheet 30 in the paper sheet transport direction is covered with an insulating layer 37. A structure of the other part of the fixing device 15 is the same as that of the first embodiment, and hence description thereof is omitted.

In this embodiment, the position of the discharge restricting shutter 35 is switched at predetermined timings between the discharge permissive position and the insulated position so that the discharge permissive condition and the discharge restricted condition are switched.

Figure 9:
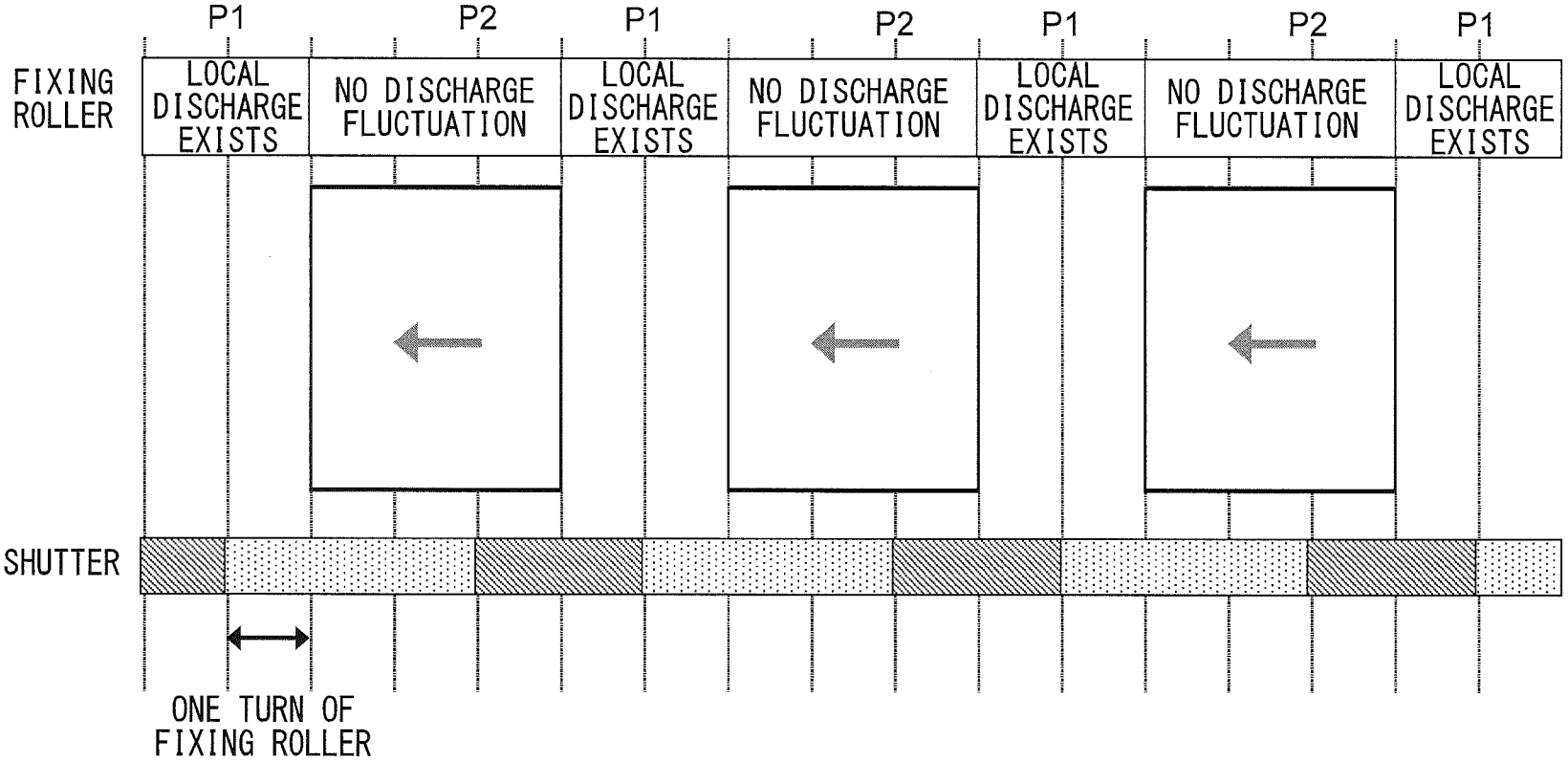
FIG. 9 is a timing chart showing a relationship between paper sheet pass timing at the fixing roller pair 20 and switch timing to the insulated position or the discharge permissive position of the discharge restricting shutter 35 in the fixing device 15 of the second embodiment.
Figure 10:
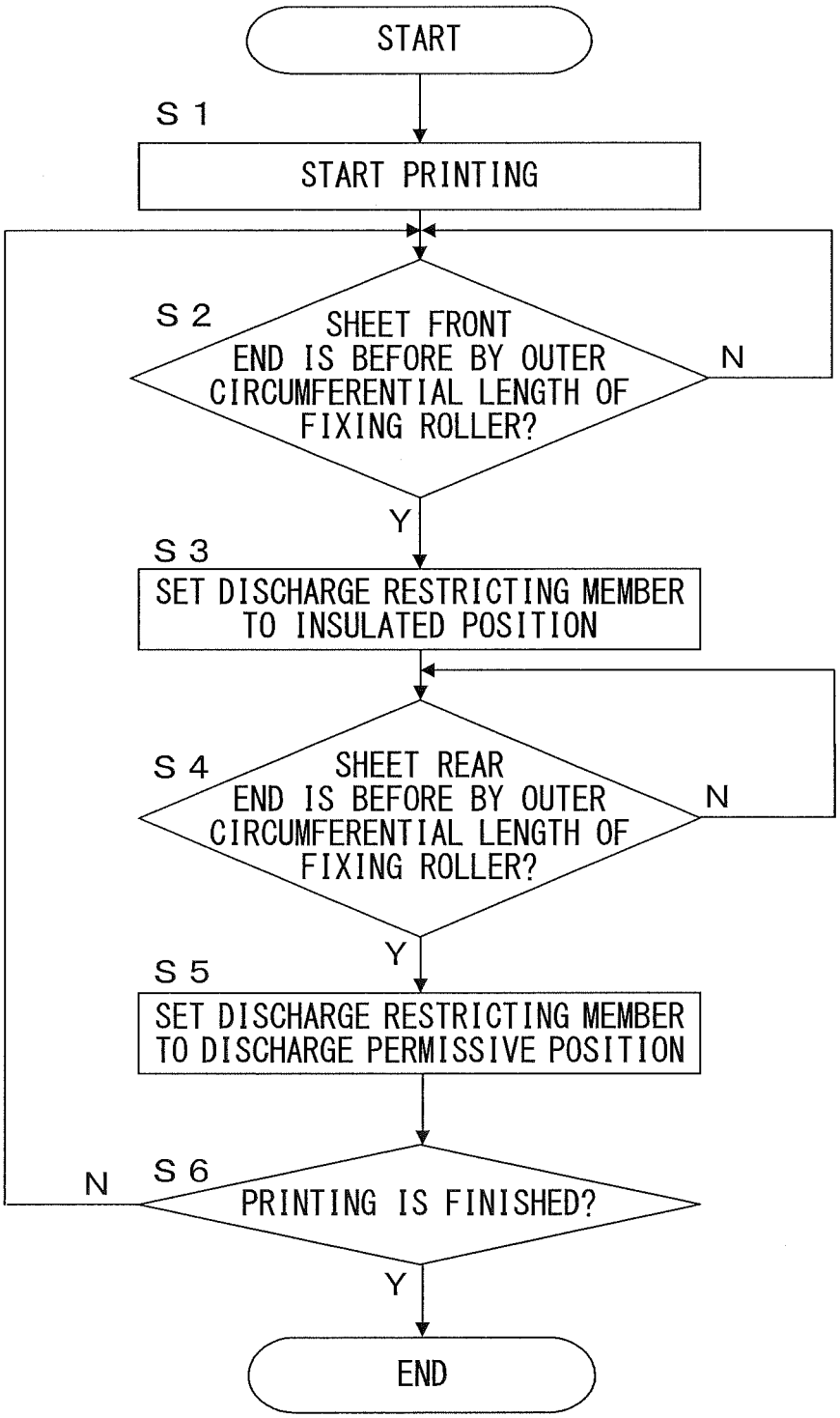
FIG. 10 is a flowchart showing the discharge control procedure of the fixing roller 20*a* in the fixing device 15 of the second embodiment.

FIG. 9 is a timing chart showing a relationship between the paper sheet pass timing at the fixing roller pair 20 and the switch timing of the discharge restricting shutter 35 to the insulated position or the discharge permissive position in the fixing device 15 of this embodiment. FIG. 10 is a flowchart showing a discharge control procedure of the fixing roller 20*a* in the fixing device 15 of this embodiment. With reference to FIGS. 6 to 9, the procedure of switching the position of the discharge restricting shutter 35 to the insulated position or the discharge permissive position along the steps of FIG. 10 is described. Note that the state in which the discharge restricting shutter 35 is in the discharge permissive position is shown as hatching areas while the state in which the same is in the insulated position is shown as dotted areas in FIG. 9.

When the print start command is input from master equipment such as a personal computer (Step S1), the fixing roller pair 20 constituted of the fixing roller 20*a* and the pressure roller 20*b* starts to rotate. At the same time, power supply to the heater 21 starts, and detection of the surface temperature of the fixing roller 20*a* by the temperature detection sensor 33 is also started. Note that the discharge restricting shutter 35 is at the discharge permissive position (of FIG. 7) when the printing starts, and hence the local discharge can occur from the fixing roller 20*a* to the neutralizing sheet 30.

When the surface temperature of the fixing roller 20*a* reaches at a predetermined temperature, the paper sheet is sent out from the sheet feed cassette 10 or the manual paper sheet tray 11. Further, the toner image is formed on the paper sheet in the image forming portion. Next, the controller 90 determines, on the basis of the detection signal of the paper sheet detection sensor 23, whether or not the front end of the paper sheet has reached the point before (on the upstream side of) the fixing nip portion N by the outer circumferential length of the fixing roller 20*a* (Step S2).

When the front end of the paper sheet reaches the point before the fixing nip portion N by the outer circumferential length of the fixing roller 20*a* (position P1 in FIG. 9) (YES in Step S2), the controller 90 outputs a control signal so as to move the discharge restricting shutter 35 from the discharge permissive position to the insulated position as shown in FIG.

6 (Step S3). In addition, the upstream side end portion of the separation plate 25 that does not overlap on the discharge restricting shutter 35 is covered with the insulating layer 37. As a result, the discharge restricted condition is realized in which the local discharge from the fixing roller 20*a* to the separation plate 25 is restricted. Further, when the paper sheet with the transferred toner image passes through the fixing nip portion N, the fixing process is performed. In addition, when the front end of the paper sheet enters the fixing nip portion N, because the local discharge to the separation plate 25 is restricted, the electrostatic scattering of the toner on the paper sheet does not occur.

Next, the controller 90 determines, on the basis of the detection signal of the paper sheet detection sensor 23, whether or not the rear end of the paper sheet that is passing through the fixing nip portion N has reached the point before (upstream side of) the fixing nip portion N by the outer circumferential length of the fixing roller 20*a* (Step S4). When the rear end of the paper sheet reaches the point before the fixing nip portion N by the outer circumferential length of the fixing roller 20*a* (position P2 of FIG. 9) (YES in Step S4), the controller 90 outputs a control signal so as to move the discharge restricting shutter 35 from the insulated position to the discharge permissive position as shown in FIG. 7 (Step S5).

In this state, the local discharge from the fixing roller 20*a* to the separation plate 25 (neutralizing sheet 30) can occur, but the local discharge point on the surface of the fixing roller 20*a* reaches the fixing nip portion N after approximately one turn of the fixing roller 20*a*. Accordingly, when the discharge restricting shutter 35 is moved to the discharge permissive position at the point before the rear end of the paper sheet by the outer circumferential length of the fixing roller 20*a*, so that the local discharge from the fixing roller 20*a* to the separation plate 25 occurs, because the local discharge point on the surface of the fixing roller 20*a* (at which the potential fluctuation has occurred) does not contact with the paper sheet that is passing through the fixing nip portion N, the fixing property is not affected.

After that, it is determined whether or not the printing is finished (Step S6). While the printing is continued (NO in Step S6), the process returns to Step S2, and afterwards the fixing process is repeated in the same procedure. While the printing is continued, because the discharge restricting shutter 35 is set to the insulated position at the point before the front end of the paper sheet that is next transported to the fixing nip portion N by the outer circumferential length of the fixing roller 20 (between sheets), the electrostatic scattering of the toner on the next paper sheet does not occur as well. On the contrary, when the printing is finished (YES in Step S6), the process is finished.

By switching the position of the discharge restricting shutter 35 to the insulated position or the discharge permissive position in the above-mentioned procedure, when the front end of the paper sheet enters the fixing nip portion N, the local discharge from the fixing roller 20*a* to the separation plate 25 is restricted. Thus, it is possible to surely prevent occurrence of the electrostatic scattering.

In addition, considering that the history of the potential fluctuation by the local discharge remains only for the outer circumferential length of the fixing roller 20*a*, the discharge restricting shutter 35 is set to the discharge permissive position before the rear end of the paper sheet by the outer circumferential length of the fixing roller 20*a*. Thus, the local discharge from the fixing roller 20*a* to the separation plate 25 can occur for as long a period as possible within a range that does not affect the fixing property of the toner image on the paper sheet that is passing through the fixing nip portion N. Thus, charge of the surface of the fixing roller 20*a* can be effectively suppressed.

In addition, because the separation plate 25 can be always in the ground state without problem in this embodiment, the structure of the fixing device 15 can be simpler than that of the first embodiment in which the ground member 31 is switched between the ground state of contacting with the separation plate 25 and the insulated state of being away from the separation plate 25.

In the control example described above, the discharge restricting shutter 35 is switched from the discharge permissive position to the insulated position at the time point when the distance from the front end of the paper sheet to the fixing nip portion N becomes identical to the outer circumferential length of the fixing roller 20*a*. It is possible, however, to switch from the discharge permissive position to the insulated position at a time point when the distance from the front end of the paper sheet to the fixing nip portion N is longer than the outer circumferential length of the fixing roller 20*a*. In addition, the discharge restricting shutter 35 is switched from the insulated position to the discharge permissive position at the time point when the distance from the rear end of the paper sheet to the fixing nip portion N becomes identical to the outer circumferential length of the fixing roller 20*a*. It is possible, however, to switch from the insulated position to the discharge permissive position at a time point when the distance from the rear end of the paper sheet to the fixing nip portion N becomes smaller than the outer circumferential length of the fixing roller 20*a*.

In addition, the upstream side end portion of the separation plate 25 in the paper sheet transport direction is covered with the insulating layer 37 in this embodiment. Alternatively, without disposing the insulating layer 37, it is possible to move the discharge restricting shutter 35 to the position overlapping the upstream side end portion of the separation plate 25 to be the discharge restricted condition. However, the gap between the separation plate 25 and the fixing roller 20*a* defined by the gap restriction member 27 is very small, and hence it is difficult to set the discharge restricting shutter 35 in the gap. For this reason, it is preferred to adopt a structure in which the region that is not overlapped with the discharge restricting shutter 35 is covered with the insulating layer 37 as described in this embodiment.

The present disclosure is not limited to the embodiments described above and can be variously modified within the scope not deviating from the spirit of the present disclosure. For instance, the embodiments described above exemplify the fixing device 15 of a thermal roller fixing type in which the toner is fixed when the paper sheet with the unfixed toner image passes through the fixing nip portion N formed between the fixing roller 20*a* and the pressure roller 20*b*. It is possible, however, to apply the present disclosure to a fixing device of a belt fixing type in which an endless fixing belt is disposed instead of the fixing roller 20*a*, and the toner is fixed when the paper sheet with the unfixed toner image passes through a fixing nip portion formed between the fixing belt and a pressure member pressed to the fixing belt.

In addition, it is a matter of course that the present disclosure can be applied to other than the monochrome printer shown in FIG. 1, namely can be applied to other image forming apparatus including the fixing device, such as a color printer, a monochrome or color copier, a digital multifunction peripheral, or a facsimile machine.

The present disclosure can be used for a fixing device equipped with a separation member for preventing a recording medium from being wrapped around a heated roller member. By using the present disclosure, it is possible to provide a fixing device and an image forming apparatus including the fixing device, which can suppress excessive charge on the heated roller member as well as occurrence of electrostatic scattering due to a local discharge from the heated roller member to the separation member.

What is claimed is:

1. A fixing device comprising:

a fixing member including a heated roller member to be heated by heating means, and a pressure member configured to contact with the heated roller member so as to form a fixing nip portion;

a separation member having conductivity disposed with a predetermined gap to a surface of the heated roller member so as to separate a recording medium after passing through the fixing nip portion from the heated roller member; and a discharge state switching mechanism for switching between a discharge permissive condition and a discharge restricted condition, the discharge permissive condition permitting a discharge from the heated roller member to the separation member, while the discharge restricted condition restricts the discharge from the heated roller member to the separation member, wherein the discharge state switching mechanism includes a ground member disposed to contact with the separation member, and an insulative discharge restricting member capable of moving along the separation member between the separation member and the heated roller member, and the discharge restricting member is set to a discharge permissive position retracted from opposed portions of the separation member and the heated roller member so as to switch to the discharge permissive condition, while the discharge restricting member is set to an insulated position between the opposed portions of the separation member and the heated roller member so as to switch to the discharge restricted condition.

2. The fixing device according to claim 1, wherein the discharge state switching mechanism is a ground member disposed in a manner capable of contacting with and separating from the separation member, and the ground member is made contact with the separation member so as to switch to the discharge permissive condition, while the ground member is made separate from the separation member so as to switch to the discharge restricted condition.

3. The fixing device according to claim 1, wherein the separation member includes a sheet-like neutralizing member attached to a side face thereof facing the heated roller member.

4. The fixing device according to claim 3, wherein the neutralizing member has a brush-like or nap-raised surface facing the heated roller member.

5. The fixing device according to claim 1, wherein the separation member includes a sheet-like neutralizing member attached to a side face thereof facing the heated roller member with a predetermined gap from an upstream side end portion of the separation member in a recording medium transport direction, and the discharge restricting member is capable of moving between the discharge permissive position retracted from opposed portions of the neutralizing member and the heated roller member and the insulated position between the opposed portions of the neutralizing member and the heated roller member, and includes an insulating layer covering a region of the separation member between the neutralizing member and the upstream side end portion.

6. The fixing device according to claim 1, wherein the separation member includes an insulative gap restriction member configured to contact with the heated roller member so as to define a gap between the separation member and the surface of the heated roller member.

7. An image forming apparatus comprising:

a fixing device including:

a fixing member including a heated roller member to be heated by heating means, and a pressure member configured to contact with the heated roller member so as to form a fixing nip portion;

a separation member having conductivity disposed with a predetermined gap to a surface of the heated roller member so as to separate a recording medium after passing through the fixing nip portion from the heated roller member; and a discharge state switching mechanism for switching between a discharge permissive condition and a discharge restricted condition, the discharge permissive condition permitting a discharge from the heated roller member to the separation member, while the discharge restricted condition restricts the discharge from the heated roller member to the separation member;

a recording medium detection mechanism disposed on an upstream side of the fixing device in a recording medium transport direction, the recording medium detection mechanism configured to detect passing of the recording medium; and a controller configured to control the discharge state switching mechanism on the basis of a detection signal from the recording medium detection mechanism, wherein the controller switches the discharge permissive condition to the discharge restricted condition when a distance between a front end of the recording medium transported to the fixing nip portion and the fixing nip portion is larger than or equal to an outer circumferential length of the heated roller member, and switches the discharge restricted condition to the discharge permissive condition when a distance between a rear end of the recording medium that is passing through the fixing nip portion and the fixing nip portion is smaller than or equal to the outer circumferential length of the heated roller member.

8. The image forming apparatus according to claim 4, wherein the controller switches the discharge permissive condition to the discharge restricted condition when the distance between the front end of the recording medium transported to the fixing nip portion and the fixing nip portion becomes identical to the outer circumferential length of the heated roller member, and switches the discharge restricted condition to the discharge permissive condition when the distance between the rear end of the recording medium that is passing through the fixing nip portion and the fixing nip portion becomes identical to the outer circumferential length of the heated roller member.

* * * * *